US007471912B2

(12) United States Patent
Sakai et al.

(10) Patent No.: US 7,471,912 B2
(45) Date of Patent: Dec. 30, 2008

(54) IMAGE FORMING APPARATUS INCLUDING INTERMEDIATE TRANSFER MEMBER AND METHOD OF CONTROLLING THE SAME

(75) Inventors: Akihiko Sakai, Abiko (JP); Shinichi Takata, Abiko (JP); Takuya Kawamura, Arakawa-ku (JP); Yuichiro Maeda, Kashiwa (JP)

(73) Assignee: Canon Kabushiki Kaisha (JP)

( * ) Notice: Subject to any disclaimer, the term of this patent is extended or adjusted under 35 U.S.C. 154(b) by 202 days.

(21) Appl. No.: 11/467,221

(22) Filed: Aug. 25, 2006

(65) Prior Publication Data

US 2007/0048032 A1 Mar. 1, 2007

(30) Foreign Application Priority Data

Aug. 30, 2005 (JP) ..... 2005-250113

(51) Int. Cl.
*G03G 15/00* (2006.01)

(52) U.S. Cl. ..... 399/82

(58) Field of Classification Search ..... 399/82, 399/401, 402

See application file for complete search history.

(56) References Cited

U.S. PATENT DOCUMENTS 4,935,786 A 6/1990 Veeder
6,078,760 A * 6/2000 Abe et al. ..... 399/45
2005/0158085 A1* 7/2005 Murakami et al. ..... 399/299

FOREIGN PATENT DOCUMENTS

JP 3-102081 A 4/1991
JP 7037304 A 2/1995

* cited by examiner

*Primary Examiner*—Quana M Grainger
(74) *Attorney, Agent, or Firm*—Rossi, Kimms & McDowell, LLP

(57) ABSTRACT

An image forming apparatus having a transfer device transferring a toner image from an intermediate transfer member to a sheet, a sheet feeder feeding the sheet to the transfer device, a sheet re-feeder, which reverses the front side and back side of the sheet to re-feed the sheet to the transfer device, and a controller, which controls the execution of a two-side copying mode, wherein when a feeding of the sheet from the sheet feeder is interrupted with a first toner image to be transferred to another sheet fed from the sheet re-feeder and a second toner image to be transferred to the sheet fed from the sheet feeder being on the intermediate transfer member, the controller controls the transfer device to perform a transfer of the first toner image and inhibit a transfer of the second toner image.

5 Claims, 11 Drawing Sheets

IMAGE FORMING APPARATUS INCLUDING INTERMEDIATE TRANSFER MEMBER AND METHOD OF CONTROLLING THE SAME

BACKGROUND OF THE INVENTION

1. Field of the Invention

The invention relates to an image forming apparatus of an electrophotographic printing type provided with an intermediate transfer member to which a developer image is temporarily transferred.

2. Description of the Related Art

In recent years, a demand for improved productivity has been more and more increasing in an image forming apparatus for forming an image on a sheet such as plain paper by an electrophotographic printing method. As such an image forming apparatus of the eletrophotographic printing type, there is one on which is carried a both-side mode for effecting image formation on both of the front side and back side of a sheet. In order to improve productivity in this two-side mode, there has been proposed a so-called through-path duplex conveying method of effecting image formation while alternately feeding a sheet fed from a sheet feeding unit and a re-fed sheet having already had an image formed on one side thereof which is conveyed from a re-feeding path (duplex path) (see Japanese Patent Publication No. H07-37304).

In this through-path duplex conveying method, when the lack of sheets in the sheet feeding unit or the faulty conveyance of a sheet on a sheet feeding and conveying path occurs, the conveyance of the sheet is stopped. If at that time, a sheet present in the duplex path is in a state in which it can be discharged out of the machine, the formation of an image to be formed on the sheet in the duplex path is continued, and this sheet is intactly discharged out of the machine as a final printed matter. This dischargeable state is a case where the movement of the sheet in the duplex path is not hindered by a sheet stopped on any one path by the above-mentioned faulty conveyance. By doing such conveyance control, it is possible to minimize the possibility that a sheet being subjected to image formation may be left in a state stagnating in the machine.

In recent years, particularly as a color image forming method by the electrophotographic printing method, there is a method using an intermediate transfer member. This intermediate transfer member is a member to which a toner image developed on a photosensitive member is temporarily transferred, and the toner image transferred to this intermediate transfer member is further transferred to a sheet. This transfer of the toner image from the intermediate transfer member to the sheet is called an intermediate transfer process.

The use of such an intermediate transfer member makes it possible to achieve a decrease in color shift and the stabilization of transfer efficiency during transfer without being affected by the quality of material and thickness of the sheet. Also, particularly when an intermediate transfer belt is used as the intermediate transfer member, it becomes possible to make the arrangement and construction in the apparatus flexible. That is, the use of the intermediate transfer belt has a side that it is advantageous to the downsizing of the entire apparatus, and has been attracting attention as an apparatus form having various kinds of superiority.

However, in an image forming apparatus which does not use the intermediate transfer member, generally the time required to convey the sheet from the sheet feeding unit becomes longer than the time required for an image forming process and therefore, it is often the case that the image forming process is started later than the start of the conveyance of the sheet.

In contrast, in an image forming apparatus using the intermediate transfer member, it is necessary to execute the intermediate transfer process (secondary transfer) and therefore, the time required for the image forming process becomes long as compared with the image forming process which does not use the intermediate transfer member. When for example, the image forming process is started after the conveyance of the sheet has been started, the time required for a toner image to be transferred onto a sheet becomes long and as a whole, the throughput is reduced.

So, in order to prevent a reduction in the number of image-formed sheets per unit time, in the image forming apparatus using the intermediate transfer member, the image forming process on the photosensitive member is started prior to the feeding of the sheet. Then, a sheet conveying process is started so as to be in accordance with the timing for performing a secondary image transferring operation to be executed after the lapse of a predetermined time from the start of this image forming process.

Let it be assumed that in the image forming apparatus using such an intermediate transfer member, as described above, an abnormality such as the lack of sheets in the sheet feeding unit or the faulty conveyance of the sheet has occurred when the through-path duplex conveyance of the sheet is being performed. It is conceivable that at the point of time whereat this abnormality has occurred, both of an image for the front side to be transferred to a sheet of which the conveyance has been interrupted and an image for the back side to be transferred to a sheet fed from a duplex path have already been transferred onto the intermediate transfer member.

Particularly when the image being transferred onto the intermediate transfer member prior to the feeding of the sheet is an image for the front side, it is necessary to once clear all toner images formed on the intermediate transfer member including the succeeding image for the back side. Consequently, even when for example, the lack of sheets has occurred or when a faultily conveyed sheet is stopped at a position whereat it does not hinder re-feeding from the duplex path, if the secondary transfer portion is spaced apart, it is impossible to effect the discharge of the sheet on the duplex path. As the result, when the lack of sheets has occurred or when the faulty conveyance on the sheet feeding path has occurred, the operation is interrupted in a state in which the sheet on the duplex path originally dischargeable as a final printed matter is stagnated in the machine.

Accordingly, the sheet on which an image is still being formed becomes stagnated in the machine and therefore, the processing for removing the stagnated sheet in the machine after the interruption of the operation becomes cumbersome, and a user's operating property is reduced. Also, the sheet originally continuedly subjected to image formation on the back side thereof and dischargeable out of the machine as a final printed matter is stopped in its unfinished state in the machine, thus resulting in a reduction in productivity and an increase in running cost due to the loss of the toner and sheets accompanying the interruption of image formation.

SUMMARY OF THE INVENTION

It is an object of the present invention to provide an image forming apparatus which solves the above-noted problems and a method of controlling the same.

It is another object of the present invention to provide an image forming apparatus which, even when the feeding of a sheet, is interrupted during a two-side mode, can continue image formation on the back side of the re-fed sheet, and a method of controlling the same.

According to a first aspect of the present invention, there is provided an image forming apparatus comprising: an image forming portion which forms a toner image on a photosensitive member; a first transfer device which transfers the toner image formed on the photosensitive member to an intermediate transfer member, the intermediate transfer member having an area to which at least two toner images of a predetermined size are transferred; a second transfer device which transfers the toner image transferred to the intermediate transfer member to a sheet; a sheet feeding device which feeds the sheet to the second transfer device; a sheet re-feeding device which reverses the front side and back side of the sheet to which the toner image has been transferred by the second transfer device and re-feeds the sheet to the second transfer device; and a controller which controls the execution of a two-side mode for transferring images to the two sides of the sheet; wherein the controller controls the image forming portion so as to alternately transfer a toner image to be transferred to another sheet from the sheet re-feeding device and a toner image to be transferred to the sheet fed from the sheet feeding device to the intermediate transfer member, and controls the sheet re-feeding device and the sheet feeding device so as to alternately repeat the re-feeding of the sheet by the sheet re-feeding device and the feeding of the sheet by the sheet feeding device, and the controller controls the second transfer device, when the feeding of the sheet has been interrupted from the sheet feeding device in a state in which a first toner image to be transferred to the another sheet fed from the sheet re-feeding device and a second toner image to be transferred to the sheet fed from the sheet feeding device are being transferred to the intermediate transfer member, so as to effect the transfer of the first toner image and inhibit the transfer of the second image.

Further features of the present invention will become apparent from the following description of exemplary embodiments with reference to the attached drawings.

DESCRIPTION OF THE EMBODIMENTS

Some embodiments of the present invention will hereinafter be described with reference to the drawings.

First Embodiment

Figure 1:
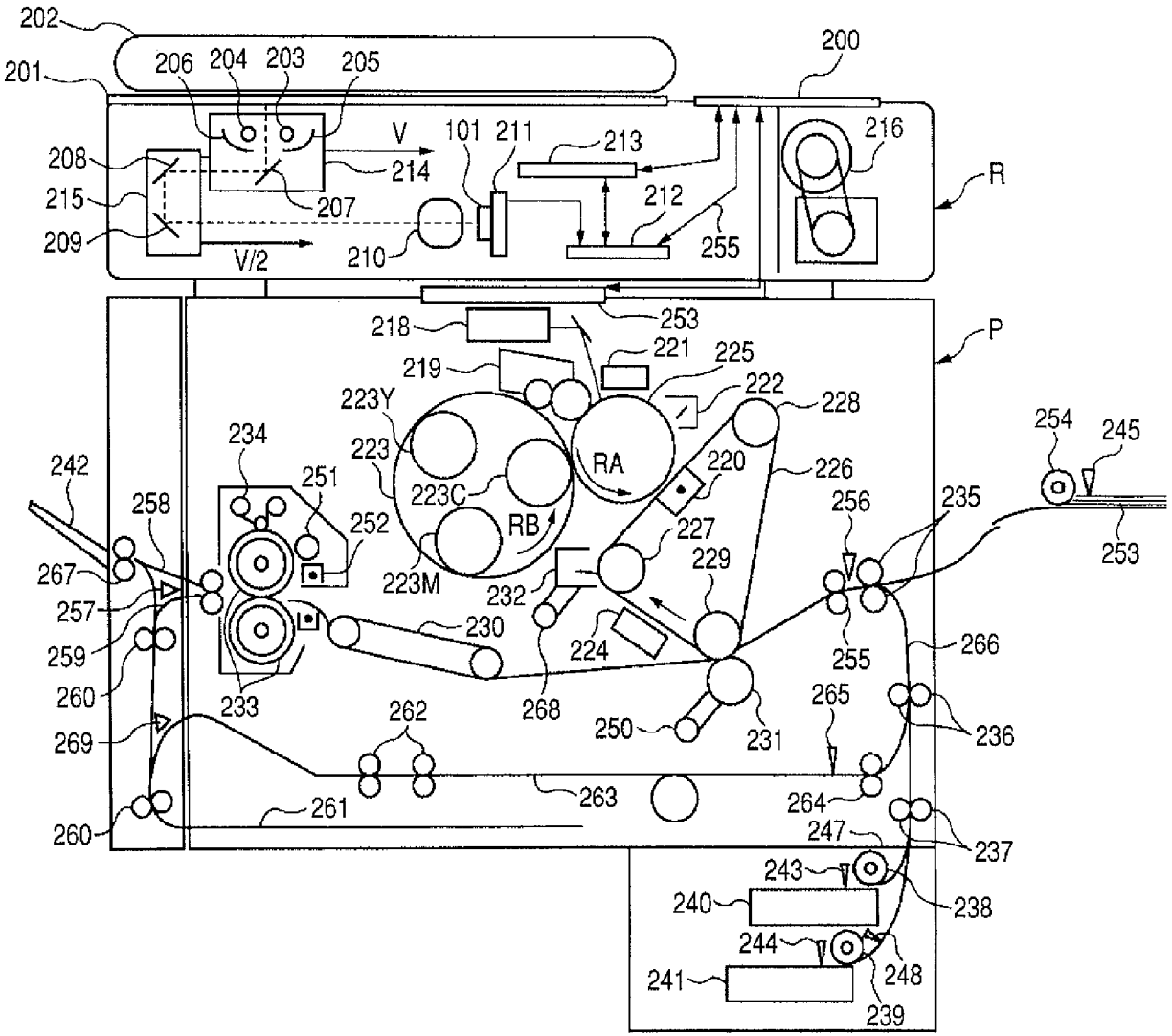
FIG. 1 is a longitudinal cross-sectional view showing the construction of an image forming apparatus according to a first embodiment of the present invention.
Figure 2:
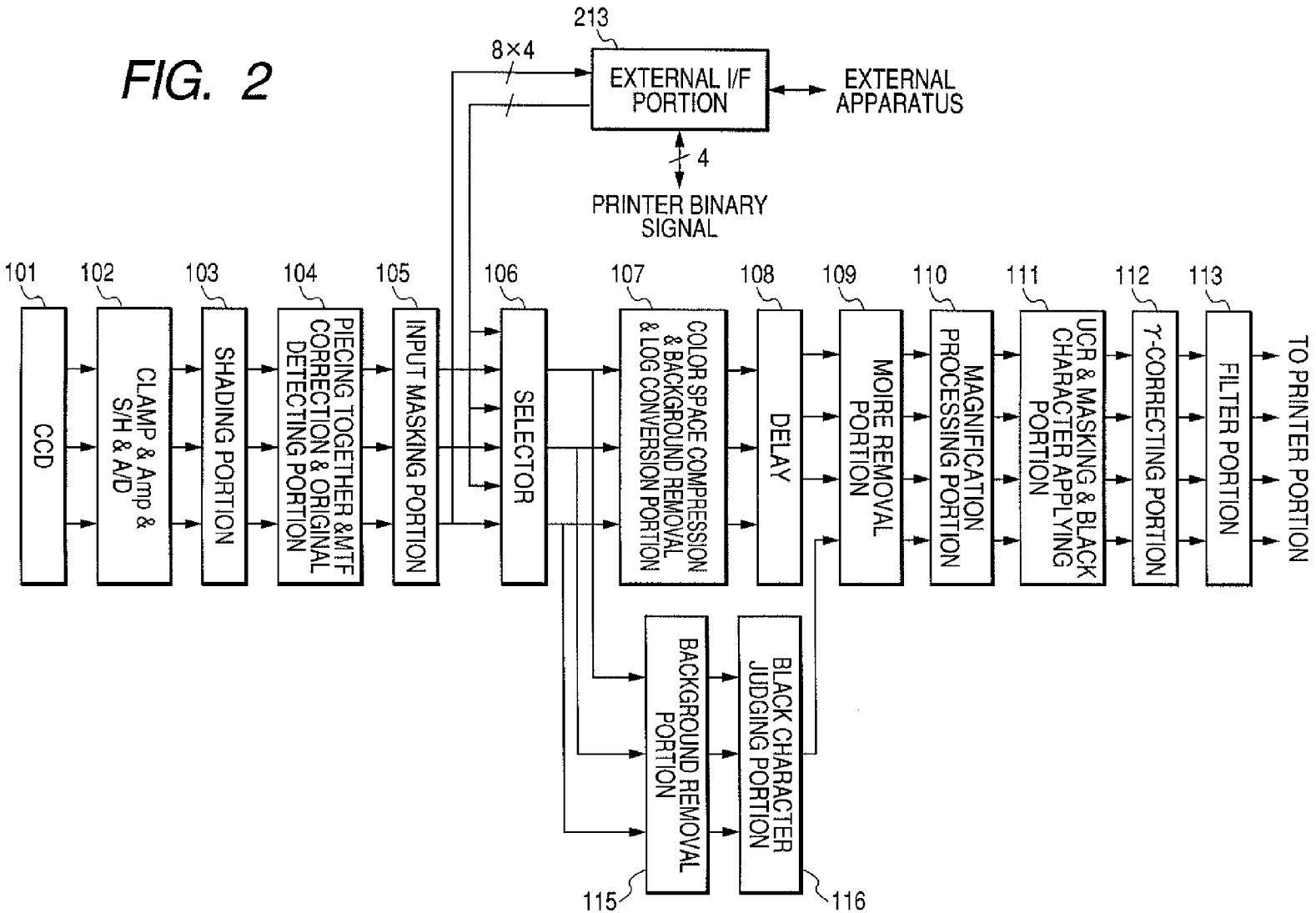
FIG. 2 is a block diagram showing the construction of the digital image processing portion 212 of FIG. 1.
Figure 3:
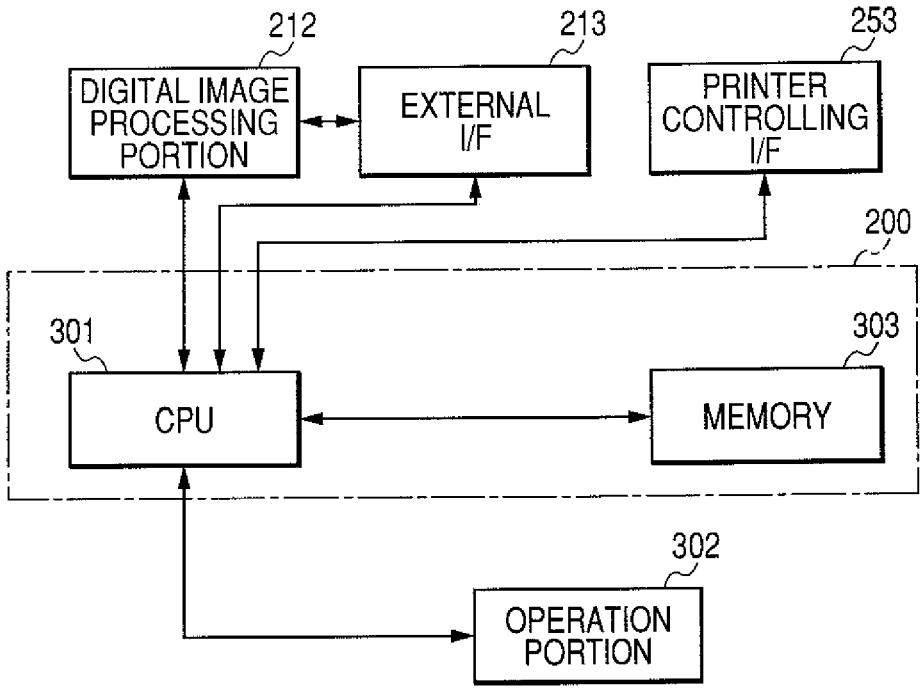
FIG. 3 is a block diagram showing the construction of the controlling portion 200 of FIG. 1.
Figure 4:
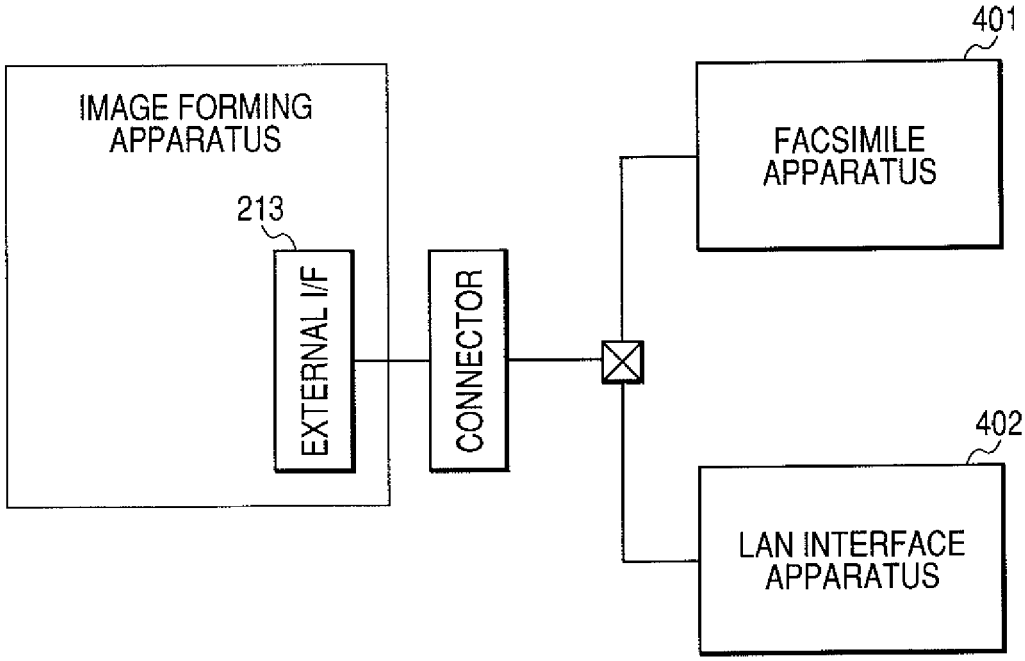
FIG. 4 is a block diagram typically showing the connected state of an external apparatus and the external I/F 213 of FIG. 2.

FIG. 1 is a longitudinal cross-sectional view showing the construction of an image forming apparatus according to a first embodiment of the present invention, FIG. 2 is a block diagram showing the construction of the digital image processing portion 212 of FIG. 1, FIG. 3 is a block diagram showing the construction of the controlling portion 200 of FIG. 1, and FIG. 4 is a block diagram typically showing the connected state of an external apparatus and the external I/F 213 of FIG. 2.

The image forming apparatus, as shown in FIG. 1, is provided with a reader portion R which can color-read a color original, and a printer portion P which can form a color image on a sheet by an electrophotograph printing method.

The reader portion R carries thereon an automatic original feeding apparatus (ADF) 202 for feeding an original to an original plate (original glass stand) 201. The original fed from the automatic original feeding apparatus 202 onto the original plate 201 is illuminated by light from light sources 203 and 204 such as halogen lamps or fluorescent lamps via corresponding reflecting shades 205 and 207. Reflected light from the illuminated original is imaged on a color CCD 101 mounted on a substrate 211, via mirrors 207 and 209 and a lens 210. The light sources 203 and 204 and the mirror 207 are contained in a carriage. The mirrors 208 and 209 are contained in a carriage 215. The carriage 214 and the carriage 215 are moved in a sub-scanning direction at a velocity V and a velocity V/2, respectively, by a drive motor 216. This sub-scanning direction is a direction orthogonal to the electrical scanning (main scanning) direction of the CCD 101. The whole surface of the original on the original plate 201 is scanned (sub-scanned) by this movement of the carriage 214 and the carriage 215.

The CCD 101 converts the imaged optical image into an electrical signal (analog image signal) and this electrical signal is inputted to the digital image processing portion 212 via the substrate 211. The digital image processing portion 212 converts the electrical signal inputted from the CCD 101 into a digital signal, effects various kinds of processing on this digital signal, and produces C, M, Y and K signals. Also, the digital image processing portion 212 effects various kinds of processing on image data inputted through the external I/F 213, and produces C, M, Y and K signals.

This digital image processing portion 212, specifically, as shown in FIG. 2, has a sample holding portion (clamp & Amp. & S/H & A/D portion) 102 to which the electrical signal (analog image signal) from the CCD 101 is inputted. The sample holding portion 102 sample-holds (S/H) the inputted analog image signal, and clamps the dark level of the analog image signal at reference potential. Then, the sample holding portion 102 amplifies the analog image signal to a predetermined level, and converts it digital image signals, e.g. R, G and B digital signals of 8 bits.

Then, the R, G and B digital signals are inputted to a shading portion 103. The shading portion 103 effects shading correction and black level correction on the inputted R, G and B digital signals. The R, G and B digital signals after the correction are inputted to a piecing together portion (piecing together & MTF correction & original detecting portion) 104. The piecing together portion 104 carries out a piecing together process, MIF correction and an original detecting process. If the CCD 101 is a 3-line CCD, the reading positions among the lines differ from each other and therefore, the piecing together process adjusts the delay amount of each line in accordance with the reading speed, and corrects signal timing so that the reading positions of the three lines may become the same. Since the modulation transfer function (MTF) of reading is changed by the reading speed and the magnificaiton rate, the MTF correction corrects the change. The original detecting process scans the original on the original plate 201 to thereby detect the size of the original.

The R, G and B digital signals of which the reading position timing has been corrected by the piecing together portion 104 are inputted to an input masking portion 105. The input masking portion 105 corrects the spectral characteristic of the CCD 101 and the spectral characteristics of the light sources 203, 204 and the reflecting shades 205, 206. The R, G and B digital signals outputted from the input masking portion 105 are inputted to a selector 106 changeable over with an external I/F signal. Also, a signal from an external apparatus is inputted to the selector 106 through an external I/F (interface) 214. The selector 106 outputs the above-mentioned R, G and B digital signals to the external I/F 214 or a downstream block which will be described later, and outputs the signal inputted through the external I/F 214 to the downstream block which will be described later.

The R, G and B digital signals outputted from the selector 106 are inputted to a color conversion portion (color space compression & background removal & LOG conversion portion) 107 and a background removal portion 115. The background removal portion 115 effects background removal on the inputted R, G and B digital signals, and the R, G and B digital signals after the background removal are inputted to a black character judging portion 116. The black character judging portion 116 judges whether character in the original is black character, and produces a black character signal from the original.

The color conversion portion 107 judges whether the R, G and B digital signals from the selector 106 are signals within a range reproducible by the printer portion P. If here, the R, G and B digital signals are not the signals within the range reproducible by the printer portion P, the R, G and B digital signals are corrected so as to become the signals within the range reproducible by the printer portion P. If the R, G and B digital signals are the signals within the range reproducible by the printer portion P, the correction of these signals is not performed. Then, a background elimination process is carried out on the R, G and B digital signals, whereafter the R, G and B digital signals are converted into C, M and Y signals by LOG conversion.

The C, M and Y signals outputted from the color conversion portion 107 are delayed in a delay portion 108 to adjust their output timing. The delayed C, M and Y signals, together with the signal produced by the black character judging portion 116, are inputted to a moire removal portion 109. The moire removal portion 109 removes moire from the inputted C, M and Y signals, and the signals after the removed of the moire are inputted to a magnification processing portion. The magnification processing portion 110 effects magnification processing in the main scanning direction on the inputted C, M and Y signals. The magnification-processed C, M and Y signals are inputted to a CMYK signal producing portion (UCR & masking & black character applying portion) 111. The CMYK signal producing portion 111 produces C, M, Y and K signals from the C, M and Y signals by UCR processing. The produced C, M, Y and K signals are corrected into signals suitable as the output of the printer portion P by a masking process and also, the judgment signal produced by the black character judging portion 116 is fed back to the C, M, Y and K signals.

The C, M, Y and K signals produced by the CMYK signal portion 111 are density-adjust in a Y correcting portion 111, and thereafter are inputted to a filter portion 113. The filter portion 113 effects smoothing or edge processing on the inputted C, M, Y and K signals, and outputs the C, M, Y and K signals after this processing.

The C, M, Y and K signals produced by the digital image processing portion 212 are inputted to a controlling portion 200. The controlling portion 200 delivers the inputted C, M, Y and K signals to the printer portion P through a printer controlling I/F 253. The controlling portion 200 performs the control of the entire image forming apparatus.

This controlling portion 200, specifically, as shown in FIG. 3, has a CPU 301 which effects the control of the entire image forming apparatus in accordance with a program stored in a memory 303, and also executes individual processing. The CPU 301 has an I/F for connecting the digital image processing portion 212, the external I/F 213 and the printer controlling I/F 253 together, and exchanges information for effecting control with each of the external I/F 213 and the printer controlling I/F 253 through this I/F. Here, the external I/F 213 is an interface for exchanging image data such as image information and code information with an external apparatus, and specifically, as shown in FIG. 4, can connect a facsimile apparatus 401, a LAN interface apparatus 402, etc. together. The printer controlling I/F 215 is an interface for connecting the CPU 301 and the printer portion P together, and inputs a control signal from the CPU 301 to the printer portion P, together with the C, M, Y and K signals delivered from the digital image processing portion 212 via the CPU 301.

Also, the CPU 301 has an I/F for connecting an operation portion 302, and effects corresponding control or processing on the basis of operation information inputted from the operation portion 302 through this I/F. Also, information to be displayed on a display panel provided in the operation portion 302 is delivered to the operation portion 302 through the above-described I/F.

The operation portion 302 has a hand key for inputting information such as the operation information by the user, and the above-mentioned display panel. Various kinds of information such as set contents and input information are displayed on the display panel. Also, a soft key for inputting information such as the operation information can be displayed on the display panel.

The printer portion P, as shown in FIG. 1, has a photosensitive member 225 rotatively driven in a direction indicated by the arrow RA in FIG. 1. Around the photosensitive member 225, there are disposed a primary charger 221, an exposing apparatus 218, a black developing apparatus 219, a color developing unit 223, a transfer charger 220 and a cleaner 222.

The primary charger 221 is a charger for charging the surface of the photosensitive member 225 to uniform potential. The exposing apparatus 218 modulates a laser beam on the basis of the C, M, Y and K signals inputted through the printer controlling I/F 215, and exposes and scans the surface of the photosensitive member 225 to and by the modulated laser beam. Thereby, electrostatic latent images corresponding to the respective colors C, M, Y and K are formed on the surface of the photosensitive member 225.

The black developing apparatus 219 supplies a black toner to the photosensitive member 225 on which an electrostatic latent image for black has been formed. Thereby, the electrostatic latent image for black formed on the photosensitive member 225 is visualized as a black toner image. The color developing unit 223 carries thereon three developing apparatuses 223Y, 223M and 223C for full-color development. The developing apparatus 223Y supplies a yellow toner to the photosensitive member 225 on which an electrostatic latent image for yellow has been formed, and visualizes the electrostatic latent image for yellow as a yellow toner image. The developing apparatus 223M supplies a magenta toner to the photosensitive member 225 on which an electrostatic latent image for magenta has been formed, and visualizes the electrostatic latent image for magenta as a magenta toner image. The developing apparatus 223C supplies a cyan toner to the photosensitive member 225 on which an electrostatic latent image for cyan has been formed, and visualizes the electrostatic latent image for cyan as a cyan toner image. When the respective colors C, M, and Y are to be developed, the developing unit 223 is rotated in a direction indicated by the arrow RB in FIG. 1, and is positioned so that the developing apparatus of a corresponding color may contact with the photosensitive member 225.

Each time a toner image is formed on the photosensitive member 225, the toner image is transferred to an intermediate transfer belt 226 by the transfer charger 220. That is, the toner images of the four colors C, M, Y and K are superposed and transferred onto the intermediate transfer belt 226. Thus, a full-color toner image is formed on the intermediate transfer belt 226. Here, any toners residual on the photosensitive member 225 after the toner images have been transferred to the intermediate transfer belt 226 are removed by the cleaner 219.

The intermediate transfer belt 226 has a circumferential length "n" times as great as the length of the outer periphery of the photosensitive member 225 (n being an integer). Due to the relation between the circumferential length of such an intermediate transfer belt 226 and the outer periphery of the photosensitive member 225, the photosensitive member 225 is rotated integer times during the time when the intermediate transfer belt 226 makes a round, and is returned to entirely the same state as that before the intermediate transfer belt 226 makes a round. Consequently, when the toner images of the four colors are to be superposed on the intermediate transfer belt 226 (the intermediate transfer belt 226 makes four rounds), the color shift by the uneven rotation of the photosensitive drum 225 can be avoided.

Also, the circumferential length of the intermediate transfer belt 226 is set to a length which can transfer a toner image of which the size along the circumferential direction thereof corresponds to two images of a predetermined size, e.g. at least A4 size (corresponds to two sheets of paper). Thereby, it becomes possible to transfer a color toner image corresponding to two sheets of paper onto the intermediate transfer belt during the time when the intermediate transfer belt 226 makes four rounds to form a color image of the four colors superposed one upon another. This is what is called two-sheet putting, and thereby an improvement in productivity is achieved.

The intermediate transfer belt 226 is passed over rollers 227, 228 and 229. The roller 227 is a drive roller for driving the intermediate transfer belt 226. The roller 228 is a tension roller for adjusting the tension of the intermediate transfer belt 226. The roller 229 is a backup roller for a secondary transfer roller 231. A reflection type sensor 224 for detecting a reference position is disposed between the roller 227 and the roller 229. The reflection type sensor 224 detects marking such as a reflection tape provided on the edge portion of the outer peripheral surface of the intermediate transfer belt 226 and outputs an I-top signal. This I-top signal is a signal for instructing to start image formation, and when this signal is inputted to the exposing apparatus 218, the exposing apparatus 218 emits a laser beam a predetermined time after, and starts exposure and scanning for the photosensitive member 225.

The secondary transfer roller 231 (movable transfer member) is driven by a transfer roller contact and separation unit 250 so as to contact with the intermediate transfer belt 226, and so as to separate from the intermediate transfer belt 226. A belt cleaner 232 is provided at a location opposed to the roller 227 with the intermediate transfer belt 226 interposed therebetween. The belt cleaner 232 is driven by a belt cleaner contact and separation unit 268 so as to contact with the intermediate transfer belt 226 or so as to separate from the intermediate transfer belt 226. When the belt cleaner 232 is brought into contact with the intermediate transfer belt 226, the residual toners on the intermediate transfer belt 226 are scraped off by the blade of the belt cleaner 232.

The toner image formed on the intermediate transfer belt 226 is transferred to a sheet fed from a cassette 240 or 241 or a manual sheet feed portion 253. Specifically, sheets contained in the cassettes 240 and 241 are picked up by pickup rollers 238 and 239, and are conveyed toward registration rollers 255 along a sheet feeding path 266 by pairs of sheet feeding rollers 237, 236 and 235. Also, sheets stacked on the manual sheet feed portion 253 are picked up by a pickup roller 254, and are fed out toward the registration rollers 255 via the pair of sheet feeding rollers 235. The cassettes 240, 241 and the manual sheet feed portion 253 are provided with sheet presence or absence detecting sensors 243, 244 and 245, respectively, for detecting the presence or absence of the sheets. Also, the cassettes 240, 241 and the manual sheet feed portion 253 are provided with sheet feeding sensors 247, 248 and 249, respectively, for detecting the faulty pickup of the sheets.

The sheet fed out from the cassette 240 or 241 or the manual sheet feed portion 253 is once stopped with its leading edge rammed against the registration rollers 255 being stopped from driving. Thereby, the correction of the skew feed of the above-mentioned sheet is performed. After this correction of the skew feed, the registration rollers 255 are driven in accordance with the image formation start timing (transfer timing), and is fed to a nip portion formed between the secondary transfer roller 231 and the intermediate transfer belt 226. At this time, the secondary transfer roller 231 is driven by the transfer roller contact and separation unit 250 and is in contact with the intermediate transfer belt 226. The toner image formed on the intermediate transfer belt 226 is transferred onto the fed sheet in the nip portion. The sheet to which the toner image has been transferred is conveyed to a fixing apparatus 234 through a conveying belt 230.

The fixing apparatus 234 has two ante-fixing chargers 251 and 252 for making up for a sucking force for the toner image on the sheet and a pair of fixing rollers 233, and a nip portion for nipping and conveying the sheet is formed between the pair of fixing rollers 233. When the sheet passes through the above-mentioned nip portion, the toner image on the sheet is heated and pressurized, and is fixed on the sheet.

The sheet passed through the fixing apparatus 234 is directed to a sheet discharging path 258 or a back side path 259 by a flapper 257. The sheet on which image formation has been completed is directed to the sheet discharging path 258 by the sheet flapper 257, and this sheet is discharged to a sheet discharge tray 242 via sheet discharge rollers 267.

Also, during a two-side mode for effecting image formation on the two sides of the sheet, the sheet having an image formed on the front side thereof is directed to the back side path 259 by the flapper 257, and this sheet is once conveyed into a two-side reversal path 261 by reversing rollers 260.

Then, after the sheet has been conveyed into the two-side reversal path 261, the conveyance direction of the sheet is changed over by a two-side reversing path guide 269. Then, the sheet has its front side and back side reversed by the reverse rotation driving of the reversing rollers 260 and the driving of duplex path conveying rollers 262, and is conveyed toward sheet re-feeding rollers 264 along a duplex path 263 with its image-formed side facing down.

The sheet being conveyed toward the sheet re-feeding rollers 264 is detected by a sheet feeding sensor 265 disposed at a location immediately before the sheet re-feeding rollers 264. When a predetermined time from this point of detection time until the leading edge of the sheet strikes against the sheet re-feeding rollers 264 being stopped from driving elapses, the sheet conveying operation is once stopped. Thereby, the correction of the skew feed of the sheet is performed.

When predetermined timing arrives after the correction of the skew feed, the sheet re-feeding rollers 264 are started and the sheet is again conveyed to the sheet feeding path 266 with its side onto which an image is to be formed being the back side. Then, image formation on the back side of the sheet is performed in a procedure similar to the image formation on the front side of the sheet. The sheet having had images formed on both of its front side and back side in this manner is directed to the sheet discharge path 258 by the sheet discharge flapper 257, and is discharged onto the sheet discharge tray 242.

Description will now be provided of the two-side mode using a through-path duplex conveying method by the two-sheet putting in the present embodiment.

Figure 5A:
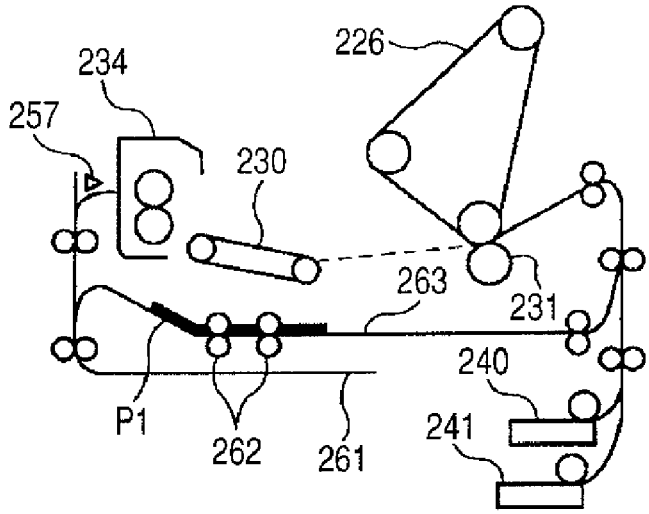
FIGS. 5A, 5B and 5C typically show the flow of a sheet when a two-side mode is executed by a conventional through-path duplex conveying method.
Figure 5B:
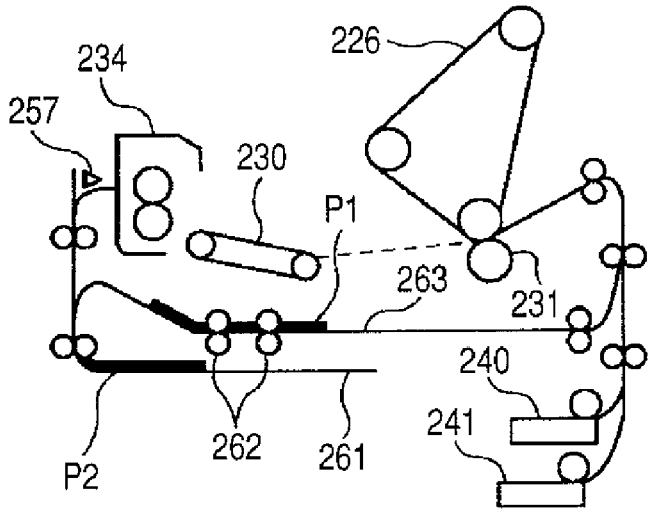
Figure 5C:
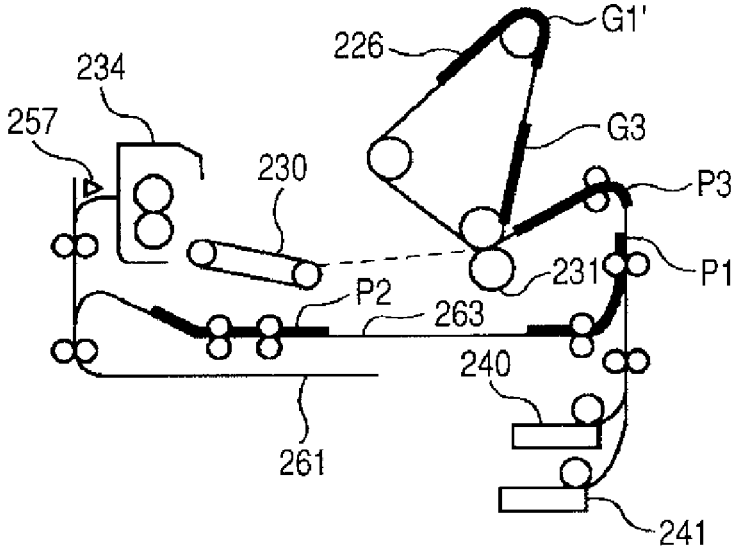
Figure 6:
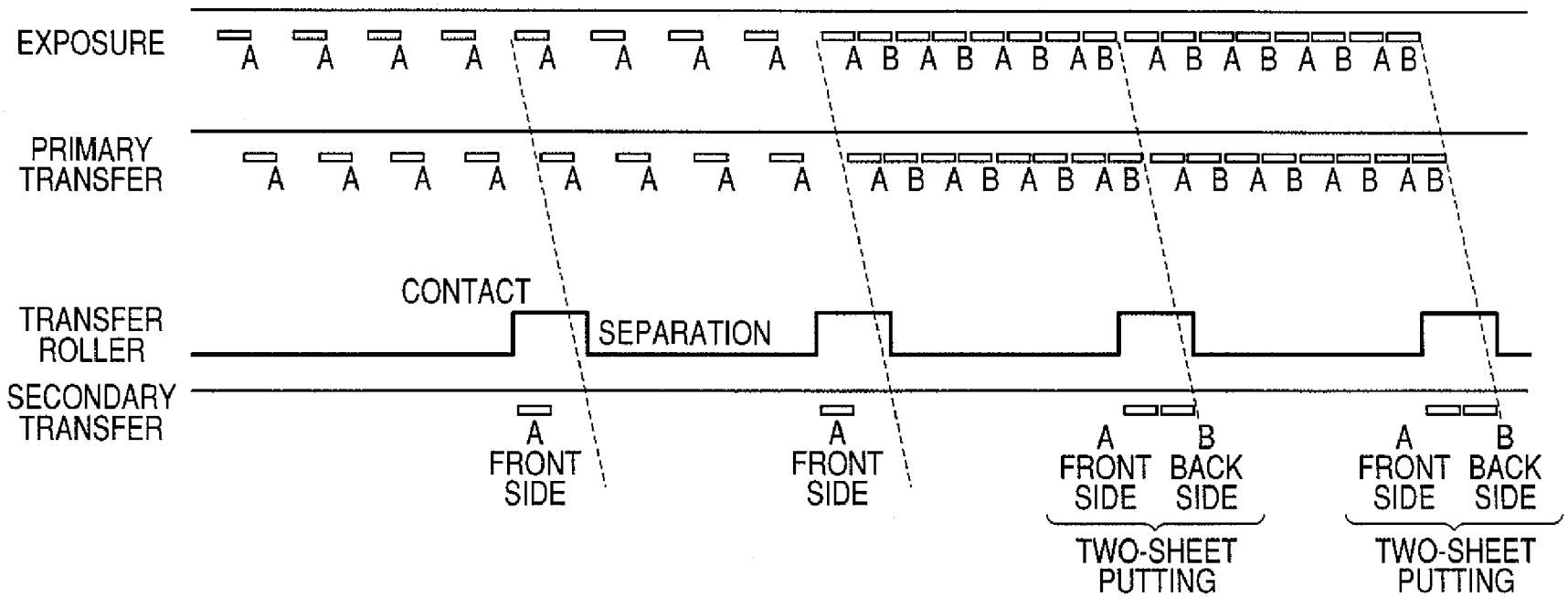
FIG. 6 typically shows the timing from an exposure to a secondary transfer when the two-side mode is executed by the conventional through-path duplex conveying method.
Figure 7:
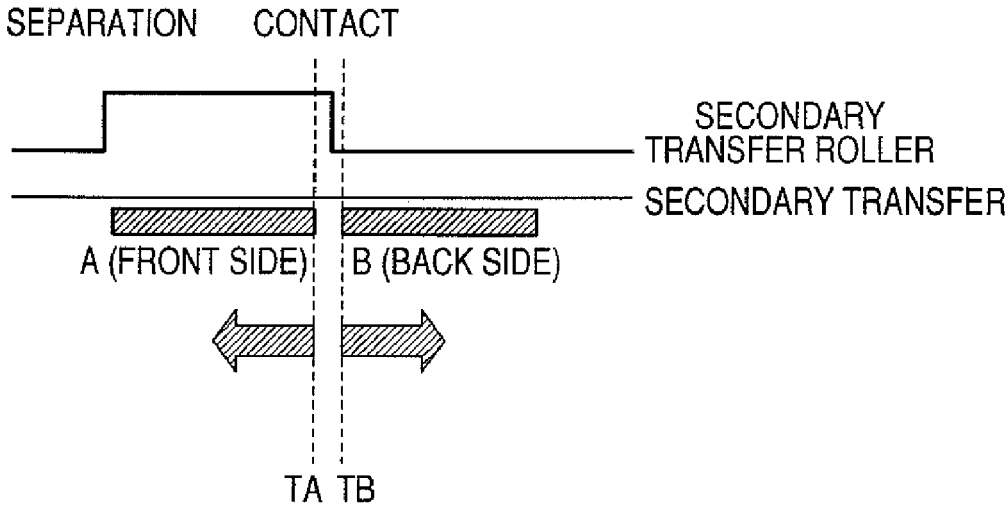
FIG. 7 shows the timing at which a secondary transfer roller 231 contacts with or separates from an intermediate transfer belt 226 when the two-side mode is performed by the conventional through-path duplex conveying method.

First, FIGS. 5A, 5B and 5C typically show the flow of the sheet in a case where two-side recording in a color image forming mode is performed by the through-path duplex conveying method. FIG. 6 typically shows the timing from exposure till secondary transfer in the case where two-side recording in the color image forming mode is performed by the through-path duplex conveying method. FIG. 7 shows the timing at which the secondary transfer roller 231 contacts with or separate from the intermediate transfer belt 226 in the case where two-side recording in the color image forming mode is performed by the through-path duplex conveying method. Description will be provided here on the assumption that the sheets are fed from the cassette 240.

First, the first sheet P1 is fed from the cassette 240, and the toner image formed on the intermediate transfer belt 226 by the secondary transfer roller 231 is transferred to the front side of this sheet P1. Then, as shown in FIG. 5A, the sheet P1 to which the color toner image has been transferred is once conveyed into the two-side reversing path 261 by the sheet discharge flapper 257 via the fixing apparatus 234, and thereafter is conveyed to the duplex path 263, and is once stopped at a standby position.

Then, the second sheet P2 is fed from the cassette 240, and the color toner image formed on the intermediate transfer belt 226 is transferred to the front side of the sheet P2. This sheet P2, as shown in FIG. 5B, is once conveyed into the two-side reversing path 261 by the sheet discharge flapper 257 via the fixing apparatus 234.

When as described above, the two sheets P1 and P2 on the front sides of which the images have been formed come to stand by in the apparatus, as shown in FIG. 5C, the third sheet P3 is fed from the cassette 240 and subsequently, the re-feeding of the sheet P1 standing by in the duplex path 263 is started. A color toner image G3 for the front side of the sheet P3 is formed on the intermediate transfer belt 226 prior to a color toner image G1' for the back side of the sheet P1, and subsequently, the color toner image G1' is formed at a predetermined interval from the color toner image G3. Then, the color toner image G3 is transferred to the front side of the sheet P3, and subsequently, the color toner image G1' is transferred to the back side of the sheet P re-fed from the duplex path 263. The sheet P3 is once conveyed into the two-side reversing path 261 by the sheet discharge flapper 257 via the fixing apparatus 234. When here, the re-feeding of the sheet P1 standing by in the duplex path 263 is started, the sheet P2 is conveyed from the two-side reversing path 261 to the duplex path 263, and is once stopped at a standby position.

The sheet P1 to the back side of which the color toner image has been transferred is discharged to the sheet discharge tray 242 via the fixing apparatus 234 and the sheet discharge path 258.

Thereafter, the transfer of the color toner images for two sheets, i.e., the color toner image for the front side of the sheet fed from the cassette 240 and the color toner image for the back side of the sheet re-fed from the duplex path 263, to the intermediate transfer belt 226 is repetitively performed. Together with this, the feeding of the sheet from the cassette 240 and the re-feeding of the sheet standing by in the duplex path are alternately performed. Thereby, the image formation on the two sides of the sheet is performed. When image formation on the front side of the last sheet is then completed, the sheets standing by in the duplex path 263 and the two-side reversing path 261 are successively re-fed, and image formation is performed on the back sides of those sheets.

In the above-described operation, processes from an exposure to a secondary transfer are performed at such timing as shown in FIG. 6. That is, the color toner image for the front side of the first sheet P1 is first formed on the intermediate transfer belt 226, and this color toner image is transferred to the sheet P1, whereafter the formation of the color toner image for the front side of the second sheet P2 is started. Then, the color toner image for the front side of the sheet P2 is transferred to the sheet P2. Thereafter, color toner images for two sheets, i.e., a color toner image for the front side of the third sheet P3 fed before the start of the re-feeding of the sheet P2, and a color toner image for the back side of the sheet P2, are formed on the intermediate transfer belt 226 As described above, the color toner image for the front side is formed prior to the color toner image for the back side.

Even if here, for example, the back of sheets in the cassette 240 (241) or the faulty conveyance of the sheet on the path from the cassette 240 (241) to the pair of sheet feeding rollers 236 occurs, this situation does not hinder the sheet in the duplex path 263 from being discharged out of the machine. Accordingly, it is possible to discharge the sheet present in the duplex path 263 out of the machine. To convey the sheet present in the duplex path 263, it is necessary that without the preceding color toner image for the front side formed on the intermediate transfer belt 226 being transferred to the sheet fed from the cassette 240 (241), only the succeeding color toner image for the back side is transferred to the re-fed sheet. That is, when the preceding color toner image for the front side formed on the intermediate transfer belt 226 passes a secondary transfer position, it is necessary to separate the secondary transfer roller 231 from the intermediate transfer belt 226 by the transfer roller contact and separation unit 250. Further, it is also necessary to remove the color toner image for the front side by the belt cleaner 232. The secondary transfer position is a position at which the secondary transfer roller 231 and the intermediate transfer belt 226 contact with each other. The separation of the secondary transfer roller 231 from the intermediate transfer belt 226 is for the purpose of preventing the secondary transfer roller 231 from being contaminated by the toners, and the toners adhering to the secondary transfer roller 231 from staining the re-fed sheet. It is necessary to bring the secondary transfer roller 231 into contact with the intermediate transfer belt 226 immediately before the color toner image on the intermediate transfer belt 226 for the succeeding back side passes the secondary transfer position. Then, with the secondary transfer roller 231 brought into contact with the intermediate transfer belt 226, the color toner image for the back side of the sheet re-fed from the duplex path 263 is transferred to this back side.

The timing for the contact between the secondary transfer roller 231 and the intermediate transfer belt 226 is such timing that the position at which the secondary transfer roller 231 contacts with the intermediate transfer belt 226 is the region between the toner image for the front side on the intermediate transfer belt 226 and the toner image for the back side.

Specifically, as shown in FIG. 7, it is necessary to bring the secondary transfer roller 231 into contact with the intermediate transfer belt 226 between timing TA and timing TB. The timing TA is timing at which the secondary transfer roller 231 contacts with the trailing edge of a toner image A for the front side, and timing TB is timing at which the secondary transfer roller 231 contacts with the leading edge of a toner image B for the back side. If for example, the secondary transfer roller 231 is brought into contact with the intermediate transfer belt 226 at timing earlier than the timing TA, the secondary transfer roller 231 will be stained with the toner for the front side, and the back side of the succeeding sheet will be stained with the toner. Also, if the secondary transfer roller 231 is brought into contact with the intermediate transfer belt 226 at timing later than the timing TB, there will occur the faulty transfer that the leading edge portion of the toner image B for the back side is not transferred to the re-fed sheet. Accordingly, in order to prevent the stain and the faulty transfer, the secondary transfer roller 231 must be brought into contact with the intermediate transfer belt 226 between the timing TA and the timing TB.

However, the interval between the timing TA and the timing TB is usually set to a very short interval in order to achieve an improvement in productivity. Accordingly, very high accuracy is required of the control for bringing the secondary transfer roller 231 into contact with the intermediate transfer belt 226 at such timing as described above.

So, in the present embodiment, there is performed the control of forming a color toner image for the back side on the intermediate transfer belt 226 prior to a color toner image for the front side without fail. By such control, the secondary transfer roller 231 is separated from the intermediate transfer belt 226 at predetermined timing when the lack of sheets in the cassettes 240 and 241 or the manual sheet feed portion 253, or the faulty conveyance of the sheet on the sheet feeding path 266 occurs. By the control of this separation timing, it becomes possible to transfer the color toner image for the back side to the back side of the re-fed sheet. That is, the discharge of the re-fed sheet becomes possible at accuracy lower than the accuracy when the above-described timing is controlled. The color toner image for the succeeding front side cannot be transferred to the sheet and therefore is removed by the belt cleaner 232.

Figure 8:
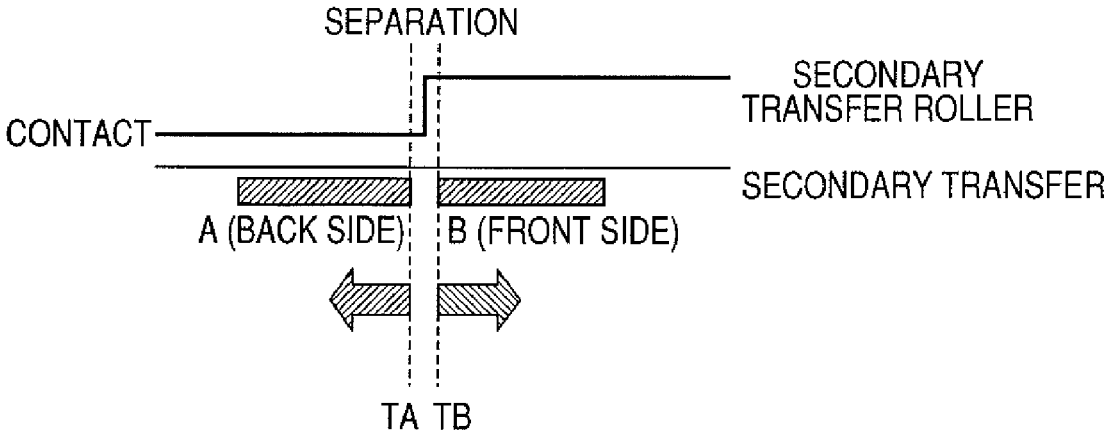
FIG. 8 typically shows the timing of separation of the secondary transfer roller 231 from the intermediate transfer belt 226 in the image forming apparatus of FIG. 1.

The separation timing of the secondary transfer roller 231 from the intermediate transfer belt 226 will be described here with reference to FIG. 8. FIG. 8 typically shows the separation timing of the secondary transfer roller 231 from the intermediate transfer belt 226 in the image forming apparatus of FIG. 1.

In the present embodiment, as shown in FIG. 8, the secondary transfer roller 231 is kept in contact with the intermediate transfer belt 226 until the color toner image A on the preceding back side passes the secondary transfer position (timing TA). Then, the secondary transfer roller 231 is separated from the intermediate transfer belt 226 before the color toner image B on the succeeding front side arrives at the secondary transfer position (timing TB). If for example, the secondary transfer roller 231 is separated from the intermediate transfer belt 226 at timing earlier than the timing TA, there occurs the faulty transfer in which the trailing edge portion of the color toner image A is not transferred to the sheet. This need be absolutely avoided. Conversely, if the secondary transfer roller 231 is separated from the intermediate transfer belt 226 at timing later than the timing TB, the surface of the secondary transfer roller 231 may be contaminated by the toner image B. However, the succeeding image forming operation is interrupted and therefore, the surface of the secondary transfer roller 231 can be cleaned at a predetermined time. Accordingly, the control of the contact or separation of the secondary transfer roller 231 in the present embodiment can be said to have a sufficient margin in timing.

Also, there is the possibility that the deviation of the timing of the completion of the separating operation of the secondary transfer roller 231 may become greater than the deviation of the timing of the start of the separating operation of the secondary transfer roller 231. Likewise, there is the possibility that the deviation of the timing of the completion of the contacting operation of the completion of the contacting operation of the secondary transfer roller may become greater than the deviation of the timing of the start of the contacting operation of the secondary transfer roller. Accordingly, it becomes easier to control the timing of the start of the separating operation of the secondary transfer roller than to control the timing of the completion of the contacting operation of the secondary transfer roller.

Figure 9A:
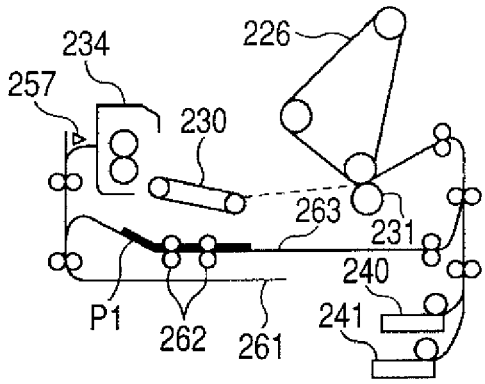
FIGS. 9A, 9B, 9C and 9D typically show the flow of the sheet during two-sheet putting in the image forming apparatus of FIG. 1.
Figure 9B:
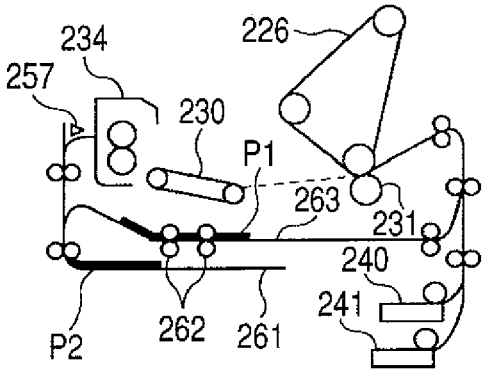
Figure 10:
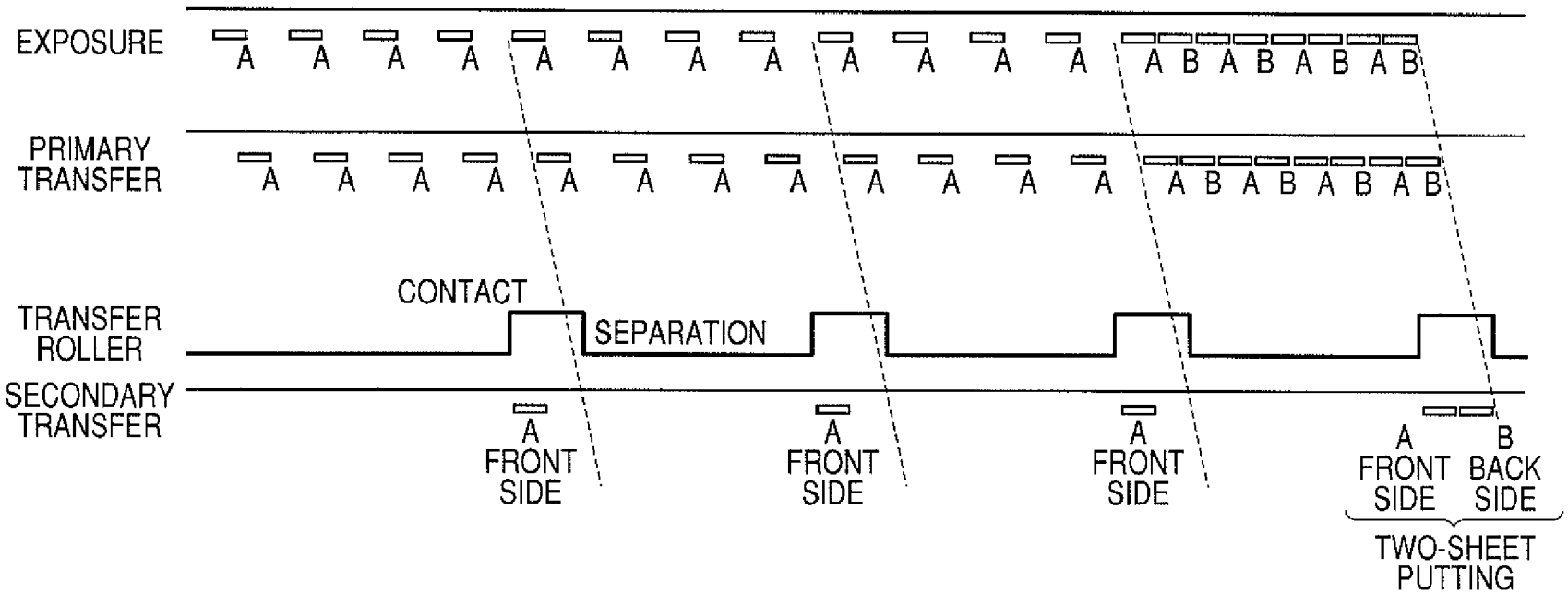
FIG. 10 typically shows the timing from an exposure to a secondary transfer when the two-side mode is executed by a through-path duplex conveying method in the image forming apparatus of FIG. 1.
Figure 11A:
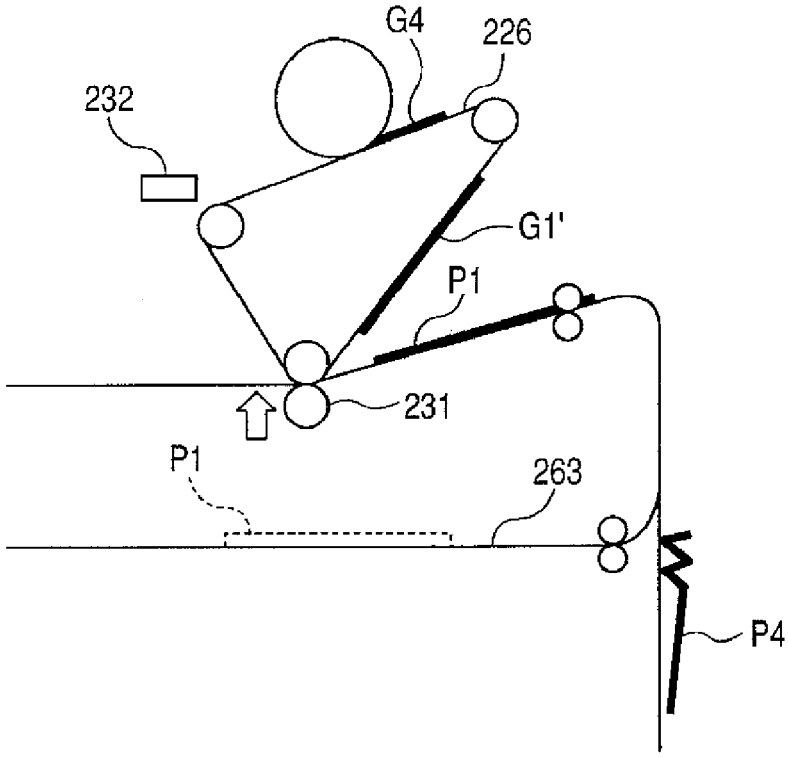
FIGS. 11A and 11B typically show the flow of the sheet during the occurrence of faulty sheet conveyance when in the image forming apparatus of FIG. 1, two-side recording in a color image forming mode is performed by the through-path duplex conveying method.
Figure 11B:
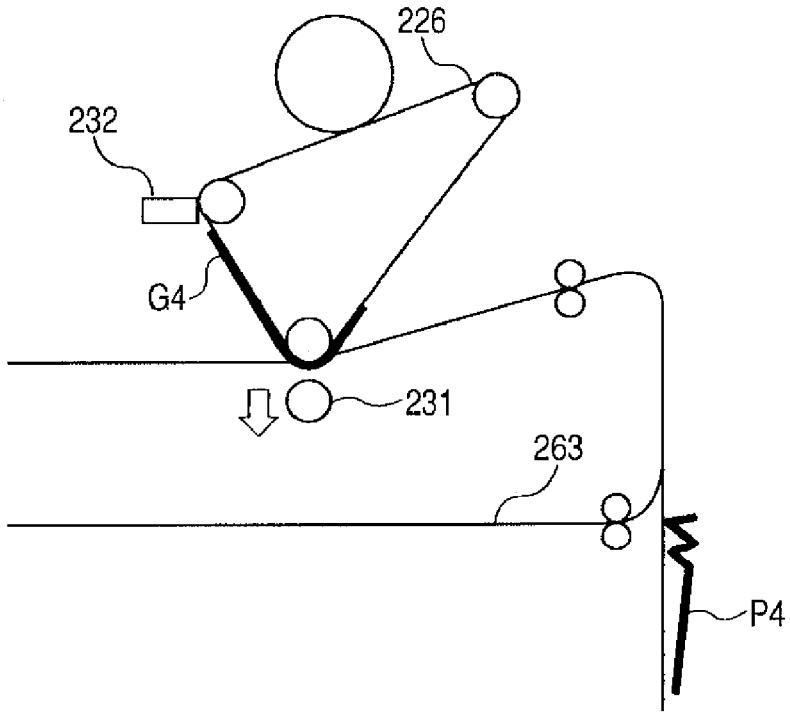

The two-sheet putting in the present embodiment will now be described with reference to FIGS. 9A to 9D, 10, 11A and 11B. FIGS. 9A, 9B, 9C and 9D typically show the flow of the sheet during the two-sheet putting in the image forming apparatus of FIG. 1. FIG. 10 typically shows the timing from an exposure to a secondary transfer when in the image forming apparatus of FIG. 1, the two-side mode is carried out by the through-path duplex conveying method. FIGS. 11A and 11B typically show the flow of the sheet when in the image forming apparatus of FIG. 1, the faulty conveyance of the sheet has occurred during the execution of the two-side mode by the through-path duplex conveying method. Here, description will be provided on the assumption that the sheets are fed from the cassette 240.

In the present embodiment, as described above, the control of forming the color toner image for the back side on the intermediate transfer belt prior to the color toner image for the front side is performed.

First, a color toner image is transferred to the front side of the first sheet P1 fed from the cassette 240. This sheet P1 is once conveyed into the two-side reversing path 261, whereafter as shown in FIG. 9A, it is conveyed to the duplex path 263, and is once stopped at the standby position. Then, a color toner image is transferred to the front side of the second sheet P2 fed from the cassette 240 This sheet P2, as shown in FIG. 9B, is once conveyed into the two-side reversing path 261. The flow hitherto is the same as the flow of the sheet in the case shown in FIGS. 5A and 5B described above.

Figure 9C:
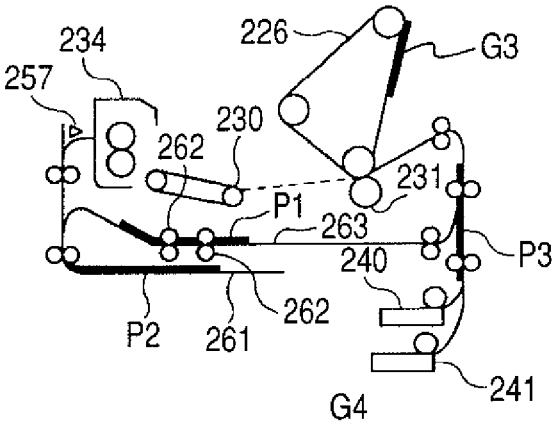
Figure 9D:
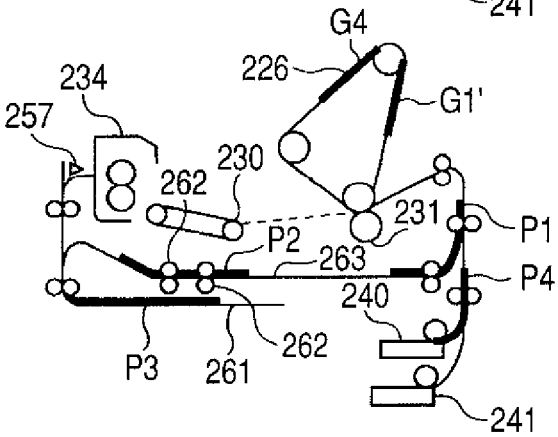

Then, as shown in FIG. 9C, the third sheet P3 is fed from the cassette 240, and the color toner image formed on the intermediate transfer belt 226 is transferred to the front side of this sheet P3 by the secondary transfer roller 231. At this time, only a color toner image G3 for the front side of the sheet P3 is formed on the intermediate transfer belt 226. Then, as shown in FIG. 9D, the sheet P3 to which the color toner image has been transferred is conveyed to the two-side reversing path 261. Along with this, the sheet P1 standing by in the duplex path 263 is re-fed toward the secondary transfer roller 231, and the sheet P2 in the two-side reversing path 261 is conveyed to the standby position in the duplex path 263.

Then, a color toner image G1' is transferred to the back side of the re-fed sheet P1, and a color toner image G4 is transferred to the front side of a sheet P4 fed from the cassette 240 subsequently to this sheet P1. At this time, the toner image G1' for the back side of the sheet P1 is formed on the intermediate transfer belt 226 prior to the toner image G4 for the front side of the sheet P4 (see FIG. 9D).

Thereafter, likewise, the re-feeding of the sheet from the duplex path 263 and the feeding of the sheet from the cassette 240 are alternately performed and thus, image formation is performed on the two sides of the sheet. At this time, a color toner image for the back side of the sheet re-fed from the duplex path 263 is formed on the intermediate transfer belt 226 prior to a color toner image for the front side of the sheet fed from the cassette 240.

The control sequence in the present embodiment is somewhat reduced in initial productivity relative to the control sequence shown in FIGS. 5A to 5C, because it includes the sequence shown in FIG. 9C extra. Thereafter, however, as described above, the two-sheet putting is repeated and also the re-feeding of the sheet from the duplex path 263 and the feeding of the sheet from the cassette 240 are alternating repeated and therefore, it never happens that the productivity for the image formation on the two sides of the sheet is further reduced.

In the present embodiment, processes from an exposure to a secondary transfer are performed at such timing as shown in FIG. 10. That is, a color toner image for the front side of the first sheet P1 is first formed on the intermediate transfer belt 226, and after this color toner image is transferred to the sheet P1, the formation of a color toner image for the front side of the second sheet P2 is started. Then, the color toner image for the front side of the sheet P2 is transferred to the sheet P2, whereafter the formation of a color toner image for the front side of the third sheet P3 is started, and this color toner image is transferred to the sheet P3.

Then, by two-sheet putting control, the formation of a color toner image for the back side of the sheet P1 re-fed from the duplex path 263 is first started, and subsequently, the formation of a color toner image for the front side of the fourth sheet P4 fed from the cassette 240 is started. Thereby, a color toner image for the back side of the sheet P1 and the color toner image for the front side of the fourth sheet P4 are formed on the intermediate transfer belt 226.

Here, let it be assumed that when as shown, for example, in FIG. 11A, the fourth sheet P4 is fed from the cassette 240 subsequently to the re-feeding of the first sheet P1 from the duplex path 263, the faulty conveyance (jam) of the sheet P4 has occurred on the sheet feeding path 266. In this case, the color toner image G1' for the back side of the sheet P1 on the intermediate transfer belt 226 is transferred to the sheet P1. In contrast, the color toner image G4 for the front side of the sheet P4 succeeding to the color toner image G1' comes to be not transferred to the sheet P4. Therefore, as shown in FIG. 11B, after the color toner image G1' has been transferred, the secondary transfer roller 231 is separated from the intermediate transfer belt 226, and the color toner image G4 on the intermediate transfer belt 226 is removed by the belt cleaner 232. The margin of the control for separating the secondary transfer roller 231 from the intermediate transfer belt 226 at predetermined timing is sufficiently great as described above and therefore, the separation control can be carried out with high accuracy. Also, the faulty conveyance (jam) of the sheet P4 on the sheet feeding path 266 does not hinder the conveyance of the sheet P1 and therefore, the transfer to the sheet P1 and the discharge of the sheet P1 become possible. Then, the sheet P1 is discharged, whereafter the operation of the apparatus is stopped, and the occurrence of the faulty conveyance of the sheet P4 is displayed on the operation portion 302 to the operator.

In the present embodiment, description has been provided of the discharge of the downstream sheet when the faulty conveyance (jam) of the fourth sheet P4 fed from the cassette 240 has occurred on the sheet feeding path 266. On the other hand, when the lack of sheets in the cassettes 240 and 241 or the manual sheet feed portion 253, or the faulty conveyance of the sheet fed from the cassette 241 on the sheet feeding path 266 has occurred, the transfer to the re-fed sheet and the discharge of the re-fed sheet are likewise performed.

Also, in the present embodiment, in the two-sheet putting control, the color toner image for the back side of the sheet re-fed from the duplex path 263 is formed prior to the toner image for the front side of the succeeding sheet. Therefore, as shown in FIG. 9C, after the image formation on the front side of the third sheet, the re-feeding of the sheet from the duplex path 263 is performed prior to the feeding of the sheet from the cassette 240. However, there is also such an image forming apparatus that depending on the shape of the conveying path, it is a basic operation to make the formation of the image for the back side of the sheet precedent. In the case of such an image forming apparatus, it is possible to realize the transfer to the re-fed sheet and the discharge of the re-fed sheet by a method similar to that in the present embodiment, without performing an operation for changing over the order of the feeding of the sheet to the secondary transfer position as shown in FIG. 9C.

Also, in the present embodiment, when two-side recording is to be performed in a black-and-white image forming mode, unlike the two-side recording in the color image forming mode, multiplex transfer on an intermediate transfer drum is unnecessary. Consequently, when two-side recording is to be performed in the black-and-white image forming mode, the preceding image formed by the two-sheet putting control may be an image for the back side, or may be an image for the front side. That is, the order of the formed images is not prescribed. However, to improve the productivity, two sheets are fed from the cassettes 240 and 241 or the manual sheet feed portion 253, and image formation on the front sides of these sheets is performed. Thereafter, the sheet feeding from the cassettes 240 and 241 or the manual sheet feed portion 253 and the re-feeding of the sheet from the duplex path 263 should preferably be alternately performed. In order to cope with this, a toner image for the front side of the sheet fed from the cassette 240 or 241 or the manual sheet feed portion 253 is formed on the intermediate transfer belt 226, prior to a toner image for the back side of the sheet re-fed from the duplex path 263.

Figure 12A:
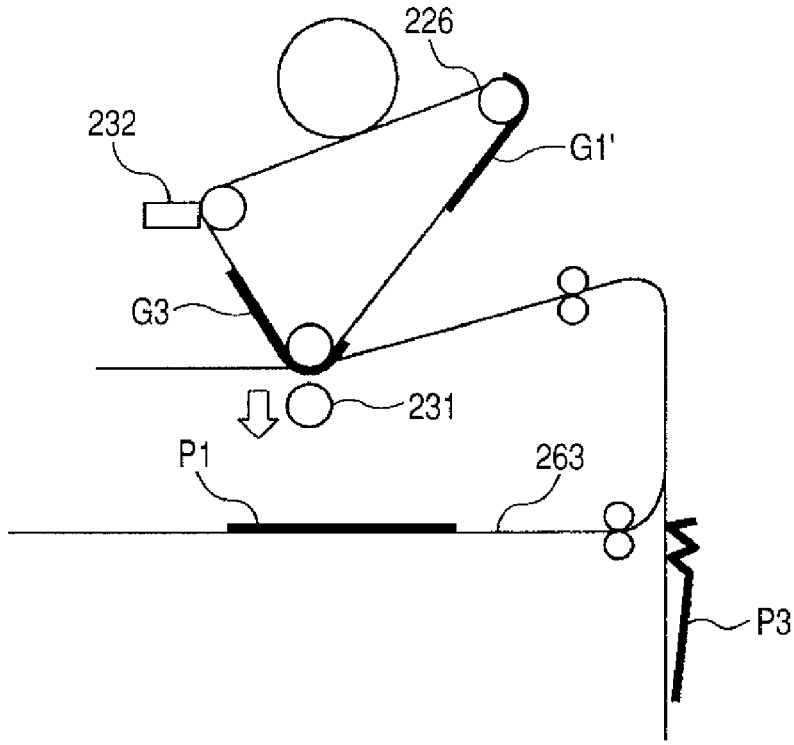
FIGS. 12A and 12B typically show the flow of the sheet when in the image forming apparatus of FIG. 1, a black-and-white two-side mode by the through-path duplex conveying method is performed.
Figure 12B:
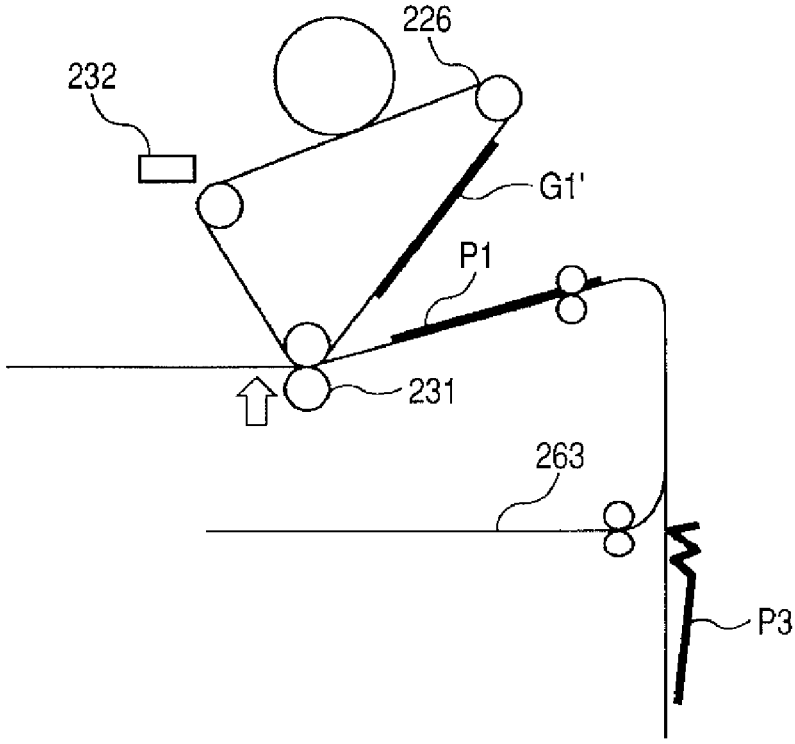

Reference is now had to FIGS. 12A and 12B to describe the control when the faulty conveyance of the recording paper fed form the cassette has occurred during the execution of two-side recording in the black-and-white image forming mode. FIGS. 12A and 12B typically show the flow of the sheet during the occurrence of the faulty conveyance of the sheet when in the image forming apparatus of FIG. 1, two-side recording is performed in the black-and-white image forming mode by the through-path duplex conveying method.

During the two-side recording in the black-and-white image forming mode in the present embodiment, as shown, for example, in FIG. 12A, the third sheet P3 from the cassette 240 is fed prior to the first sheet standing by in the duplex path 263. At this time, the toner image G3 for the front side of the sheet P3 is formed on the intermediate transfer belt 226 prior to the toner image G1' for the back side of the sheet P1. If here, the faulty conveyance (jam) of the sheet P3 occurs on the sheet feeding path 266, all of the toner images G3 and G1' formed on the intermediate transfer belt 226 are removed by the belt cleaner 232. At this time, the sheet P1 remains stopped at a predetermined position on the duplex path 263.

Thereafter, as shown in FIG. 12B, only the toner image G1' for the back side of the sheet P1 is re-formed on the intermediate transfer belt 226, and the sheet P1 stopped in the duplex path 263 is re-fed at predetermined timing, and this toner image G1' is transferred to the re-fed sheet P1. Thereby, the transfer to the sheet P1 and the discharge of the sheet P1 re-red from the duplex path 263 are realized. Then, after the sheet P1 has been discharged, the operation of the apparatus is stopped, and the occurrence of the faulty conveyance of the sheet is displayed on the operation portion 302 to the operator.

Here has been shown an example of the discharge of the downstream sheet in the case of the black-and-white image two-side mode using the two-sheet putting. Even in other construction, for example, in a case where the intermediate transfer belt 226 is constructed so as to have a circumferential length enabling N sheets (three or more sheets) to be put, and toner image for N sheets (three or more sheets) are formed on the intermediate transfer belt 226, the transfer to the re-fed sheet and the discharge of the re-fed sheet can be realized by a similar method.

Second Embodiment

Figure 13A:
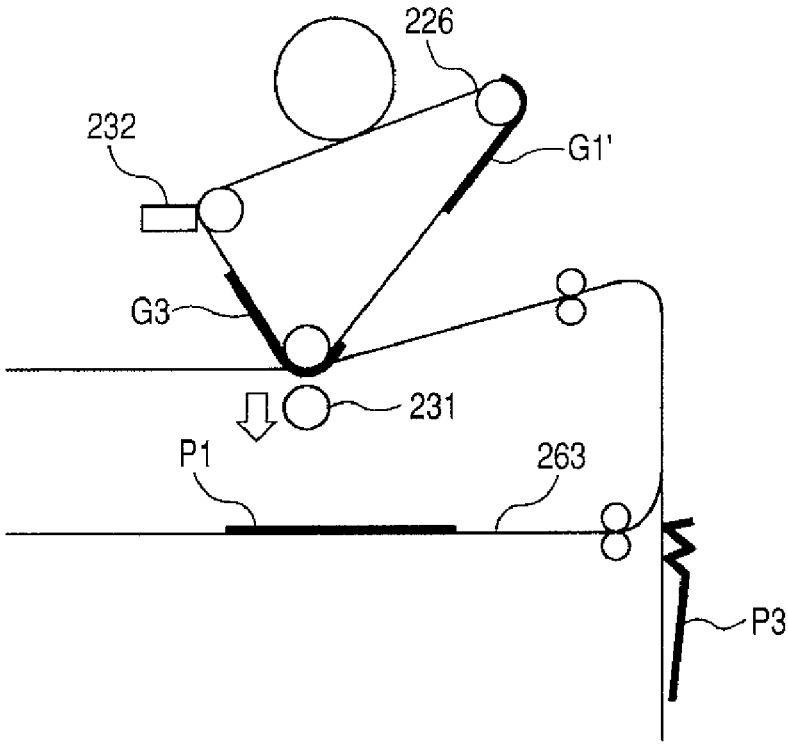
FIGS. 13A and 13B typically shows the flow of the sheet during faulty sheet conveyance when in an image forming apparatus according to a second embodiment of the present invention, two-side recording in the color image forming mode is performed by the through-path duplex conveying method.
Figure 13B:
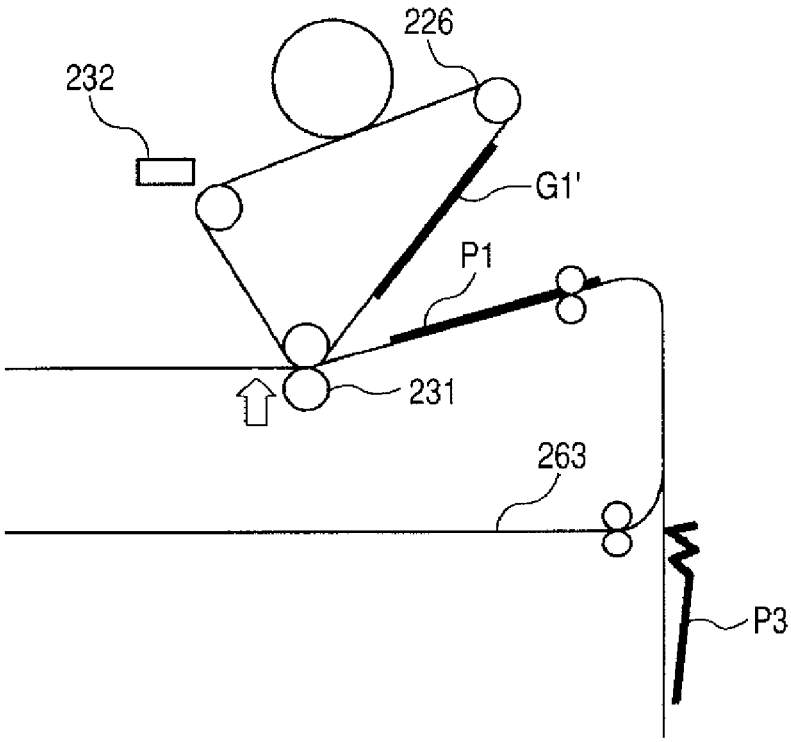

A second embodiment of the present invention will now be described with reference to FIGS. 13A and 13B. FIGS. 13A and 13B typically show the flow of a sheet during the faulty conveyance of the sheet when in an image forming apparatus according to the second embodiment of the present invention, two-side recording in the color image forming mode is performed by the through-path duplex conveying method. The image forming apparatus according to the present embodiment has the same construction as that according to the above-described first embodiment, and need not be described. The same members as those in the first embodiment are given the same reference characters, and description will be provided by the use of those reference characters.

The two-side recording in the color image forming mode by the through-path duplex conveying method in the present embodiment is that shown in FIGS. 5A to 5C described above, That is, image formation is performed on the front sides of two sheets fed from the cassette 240, whereafter the feeding of a sheet from the cassette 240 and the re-feeding of the sheet from the duplex path 263 are alternately repetitively performed. At this time, a color toner image for the front side of the sheet fed from the cassette 240 is formed on the intermediate transfer belt 226 by the two-sheet putting control, prior to a color toner image for the back side of the sheet re-fed from the duplex path 263.

In a state as shown, for example, in FIG. 13A wherein the first sheet P1 stands by in the duplex path 263, the feeding of the third sheet P3 is started from the cassette 240. At this time, a color toner image G3 for the front side of the sheet P3 fed from the cassette 240 is formed on the intermediate transfer belt 226 prior to a color toner image G1' for the back side of the sheet P1 re-fed from the duplex path 263.

If here, the faulty conveyance (jam) of the sheet P3 occurs on the sheet feeding path 266, the color toner image G3 for the front side of the sheet P3 formed on the intermediate transfer belt 226 comes to be not transferred to the sheet P3. Therefore, the secondary transfer roller 231 is separated from the intermediate transfer belt 226 before the color toner image G3 passes the secondary transfer position, and the color toner image G3 on the intermediate transfer belt 226 is removed by the belt cleaner 232.

Thereafter, as shown in FIG. 13B, the secondary transfer roller 231 is brought into contact with the intermediate transfer belt 226 at the timing after the color toner image G3 on the intermediate transfer belt 226 has passed the secondary transfer position and immediately before the color toner image G1' passes the secondary transfer position. This timing corresponds to between the timing TA and timing TB of FIG. 7. Then, the toner image G1' for the back side of the sheet P1 is transferred to the sheet P1 re-fed from the duplex path 263. Thereby, the transfer to the sheet P1 and the discharge of the sheet P1 re-fed from the duplex path 263 are realized. After the sheet P1 has been discharged, the operation of the apparatus is stopped, and the occurrence of the faulty conveyance of the sheet is displayed on the operation portion 302 to the operator.

In the present embodiment, the control of the contact and separation of the secondary transfer roller 231 with and from the intermediate transfer belt 226, as described above, is small in margin (the interval between the timing TA and timing TB of FIG. 7 is very short in time). Accordingly, high accuracy is required of this control, as compared with the control in the above-described first embodiment. To make the margin of this control great, the interval between the timing TA and timing TB of FIG. 7 is lengthened in time within a range in which for example, an amount of reduction in productivity is allowed. That is, image formation timing is controlled so as to widen the interval between the color toner image for the front side of the sheet fed from the cassette 240 and the color toner image for the back side of the sheet re-fed from the duplex path 263.

Also, in the present embodiment, the transfer to the re-fed sheet and the discharge of the re-fed sheet in a faulty conveyance of the two-side recording in the black-and-white image forming mode using two-sheet putting can be performed in a sequence similar to that in the first embodiment.

Also, in the present embodiment, there has been shown an example of the case of two-side recording in the color image forming mode using the two-sheet putting control. Even in other construction, for example, in a case where the intermediate transfer belt 226 is constructed so as to have a circumferential length enabling N sheet (three or more sheets) to be put, and toner image for N sheets (three or more sheets) are formed on the intermediate transfer belt 226, the transfer to the re-fed sheet and the discharge of the re-fed sheet can be realized by a similar method.

Also, in the present embodiment, design is made such that the intermediate transfer belt 226 is caused to make four rounds to perform multiplex transfer. Even in an image forming apparatus having other construction, for example, a construction in which an image forming unit (unit including a photosensitive member and a developing device) for each color is disposed along the intermediate transfer belt, and multiplex transfer of four colors is performed during the time when the intermediate transfer belt 226 makes a round, it is possible to realize the transfer to the re-fed sheet and the discharge of the re-fed sheet by a similar method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-250113, filed Aug. 30, 2005, which is hereby incorporated by reference herein in its entirety.

What is claimed is:

1. An image forming apparatus comprising:

an image forming portion, which forms a toner image on a photosensitive member;

a first transfer device, which transfers the toner image formed on said photosensitive member to an intermediate transfer member, said intermediate transfer member having an area to which at least two toner images of a predetermined size are transferred;

a second transfer device, which transfers the toner image transferred on said intermediate transfer member to a sheet;

a sheet feeding device, which feeds the sheet to said second transfer device;

a sheet re-feeding device, which reverses a front side and a back side of the sheet to which the toner image has been transferred by said second transfer device and re-feeds the sheet to said second transfer device; and a controller, which controls an execution of a two-side mode for transferring images to two sides of the sheet, wherein said controller controls said image forming portion so as to alternately transfer a toner image to be transferred to another sheet fed from said sheet re-feeding device and a toner image to be transferred to the sheet fed from said sheet feeding device to said intermediate transfer member, and controls said sheet re-feeding device and said sheet feeding device so as to alternately repeat a re-feeding of the another sheet by said sheet re-feeding device and a feeding of the sheet by said sheet feeding device, and wherein said controller controls said second transfer device, in a case that the feeding of the sheet has been interrupted from said sheet feeding device in a state in which a first toner image to be transferred to the another sheet fed from said sheet re-feeding device and a second toner image to be transferred to the sheet fed from said sheet feeding device are being transferred to said intermediate transfer member, so as to perform a transfer of the first toner image and inhibit a transfer of the second toner image, and wherein said second transfer device has a movable transfer member contacting with and separating from said intermediate transfer member, and said controller separates said movable transfer member from said intermediate transfer member to inhibit the transfer of the second toner image, and wherein the first toner image is transferred to said intermediate transfer member prior to the second toner image, and said controller separates said movable transfer member from said intermediate transfer member after the first toner image has been transferred to the another sheet fed by said sheet re-feeding device.

2. An image forming apparatus comprising:

an image forming portion, which forms a toner image on a photosensitive member;

a first transfer device, which transfers the toner image formed on said photosensitive member to an intermediate transfer member, said intermediate transfer member having an area to which at least two toner images of a predetermined size are transferred;

a second transfer device, which transfers the toner image transferred on said intermediate transfer member to a sheet;

a sheet feeding device, which feeds the sheet to said second transfer device;

a sheet re-feeding device, which reverses a front side and a back side of the sheet to which the toner image has been transferred by said second transfer device and re-feeds the sheet to said second transfer device; and a controller, which controls an execution of a two-side mode for transferring images to two sides of the sheet, wherein said controller controls said image forming portion so as to alternately transfer a toner image to be transferred to another sheet fed from said sheet re-feeding device and a toner image to be transferred to the sheet fed from said sheet feeding device to said intermediate transfer member, and controls said sheet re-feeding device and said sheet feeding device so as to alternately repeat a re-feeding of the another sheet by said sheet re-feeding device and a feeding of the sheet by said sheet feeding device, and p1 wherein said controller controls said second transfer device, in a case that the feeding of the sheet has been interrupted from said sheet feeding device in a state in which a first toner image to be transferred to the another sheet fed from said sheet re-feeding device and a second toner image to be transferred to the sheet fed from said sheet feeding device are being transferred to said intermediate transfer member, so as top perform a transfer of the first toner image and inhibit a transfer of the second toner image, and wherein said second transfer device has a movable transfer member contacting with and separating from said intermediate transfer member, and said controller separates said movable transfer member from said intermediate transfer member to inhibit the transfer of the second toner image, and wherein the second toner image is transferred to said intermediate transfer member prior to the first toner image, and said controller separates said movable transfer member from said intermediate transfer member when the second toner image is passing said second transfer device, and brings said movable transfer member into contact with said intermediate transfer member after the second toner image has passed said second transfer device.

3. An image forming apparatus according to claim 1, wherein the case that the feeding of the sheet has been interrupted from said sheet feeding device includes a state in which sheets have become exhausted and a state of a faulty conveyance of the sheet.

4. An image forming apparatus comprising:

an image forming portion, which forms a toner image on a photosensitive member;

an intermediate transfer member, which has an area to which at least two toner images of a predetermined size are transferred;

a first transfer device, which transfers the toner image formed on said photosensitive member to said intermediate transfer member;

a second transfer device, which transfers the toner image transferred on said intermediate transfer member to a sheet, said second transfer device having a transfer roller contacting with and separating from said intermediate transfer member, and a driving device, which brings said transfer roller into contact with and separating said transfer roller from said intermediate transfer member;

a sheet feeding device, which feeds the sheet to said second transfer device;

a sheet re-feeding device, which reverses a front side and a back side of the sheet to which the toner image has been transferred by said second transfer device and re-feeds the sheet to said second transfer device; and a controller, which controls an execution of a two-side mode for transferring images to two sides of the sheet, wherein said controller controls said image forming portion so as to alternately transfer a toner image to be transferred to another sheet fed from said sheet re-feeding device and a toner image to be transferred to the sheet fed from said sheet feeding device to said intermediate transfer member, and controls said sheet re-feeding device and said sheet feeding device so as to alternately repeat a re-feeding of the another sheet by said sheet re-feeding device and a feeding of the sheet by said sheet feeding device, and wherein said controller controls said driving device, when the feeding of the sheet has been interrupted from said sheet feeding device in a state in which a first toner image to be transferred to the another sheet fed from said sheet re-feeding device and a second toner image to be transferred to the sheet fed from said sheet feeding device are being transferred to said intermediate transfer member, so as to bring said transfer roller into contact with said intermediate transfer member when said first toner is passing said second transfer device, and separated said transfer roller from said intermediate transfer member when said second toner image is passing said second transfer device.

5. An image forming apparatus according to claim 2, wherein the case that the feeding of the sheet has been interrupted from said sheet feeding device includes a state in which sheets have become exhausted and a state of a faulty conveyance of the sheet.

* * * * *